US006291420B1

(12) United States Patent
Guerin et al.

(10) Patent No.: US 6,291,420 B1
(45) **Date of Patent: *Sep. 18, 2001**

(54) SYSTEM CONTAINING A NON-IONIC SURFACTANT AND AN ALKALI METAL SILICATE

(75) Inventors: Gilles Guerin, Eaubonne; Daniel Joubert, Vineuil-Saint-Firmin; Charles Phan, Aubervilliers; Kenneth Wong, Paris, all of (FR)

(73) Assignee: Rhodia Chimie, Courbevoie Cedex (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/117,475

(22) PCT Filed: Jan. 27, 1997

(86) PCT No.: PCT/FR97/00152

§ 371 Date: Jul. 31, 1998

§ 102(e) Date: Jul. 31, 1998

(87) PCT Pub. No.: WO97/28240

PCT Pub. Date: Aug. 7, 1997

(30) Foreign Application Priority Data

Jan. 31, 1996 (FR) ..... 96 01124
Sep. 11, 1996 (FR) ..... 96 11092

(51) Int. Cl.[7] ..... C11D 11/04; C11D 1/66; C11D 3/08

(52) U.S. Cl. ..... 510/441; 510/349; 510/421; 510/356; 510/360; 510/470; 510/511; 510/438

(58) Field of Search ..... 510/441, 349, 510/421, 356, 360, 470, 511, 438

(56) References Cited

U.S. PATENT DOCUMENTS

| | | | | |
|---|---|---|---|---|
| 3,741,904 | * | 6/1973 | Christensen et al. | 510/224 |
| 3,920,586 | * | 11/1975 | Bonaparte et al. | 252/531 |
| 4,115,308 | | 9/1978 | Guerry | 252/135 |
| 4,457,854 | | 7/1984 | Gangwisch et al. | 252/91 |
| 4,515,704 | * | 5/1985 | Akred et al. | 510/418 |
| 5,223,179 | * | 6/1993 | Conner et al. | 134/25.2 |
| 5,332,528 | * | 7/1994 | Pan et al. | 510/299 |
| 5,338,491 | * | 8/1994 | Connor et al. | 252/548 |
| 5,454,982 | * | 10/1995 | Murch et al. | 510/350 |
| 5,501,814 | * | 3/1996 | Engelskirchen et al. | 510/471 |
| 5,520,841 | * | 5/1996 | Block et al. | 510/397 |
| 5,536,437 | * | 7/1996 | Motyka | 510/365 |
| 5,700,771 | * | 12/1997 | Hardy et al. | 510/315 |
| 5,750,485 | * | 5/1998 | Baillely et al. | 510/315 |
| 5,750,733 | * | 5/1998 | Vermeer et al. | 549/346 |
| 5,854,196 | * | 12/1998 | Baillely et al. | 510/427 |
| 5,858,957 | * | 1/1999 | Donoghue et al. | 510/445 |

FOREIGN PATENT DOCUMENTS

| | | |
|---|---|---|
| 0 282 863 | 9/1988 | (EP) . |
| 2 135 285 | 7/1975 | (FR) . |
| 1 346 227 | 2/1974 | (GB) . |
| 90/06353 | 6/1990 | (WO) . |
| 93 23522 | 11/1993 | (WO) . |

* cited by examiner

*Primary Examiner*—Yogendra N. Gupta
*Assistant Examiner*—Brian P. Mruk
(74) *Attorney, Agent, or Firm*—Burns, Doane, Swecker & Mathis, L.L.P.

(57) ABSTRACT

A system in the form of an aqueous dispersion or granules containing at least one liquid, waxy or pasty non-ionic surfactant and an alkali metal silicate. The system is prepared using a concentrated aqueous alkali metal silicate solution as the continuous liquid phase optionally containing glycerol, in which is dispersed at least one liquid, pasty or waxy non-ionic surfactant that is non-miscible or poorly compatible with said concentrated alkali metal silicate solution, and at least one non-ionic or anionic surfactant that is compatible with said concentrated alkali metal silicate solution and capable of causing the dispersion of said liquid, pasty or waxy non-ionic surfactant(s) in said concentrated alkali metal silicate solution. The resulting dispersion is optionally dried to produce a rigid alkali metal silicate shell encapsulating droplets or particles of the liquid, pasty or waxy non-ionic surfactant(s). The system may optionally further contain at least one other detergent builder and may be used as a component of a detergent composition, particularly for use in washing machines, or as the detergent composition itself.

18 Claims, No Drawings

SYSTEM CONTAINING A NON-IONIC SURFACTANT AND AN ALKALI METAL SILICATE

The present invention relates to a system based on at least one liquid, waxy or pasty nonionic surfactant and on an alkali metal silicate, the said system being in the form of granules or a stable aqueous dispersion. This system can be used as a constituent of detergent compositions in liquid or powder form. The invention is also directed towards the detergent compositions in powder or liquid form based on the said system.

It is known to convert organic materials, in particular surfactants, that are liquid under standard temperature and pressure conditions, into pulverulent products by adsorption and/or absorption onto a solid support, generally a more or less porous inorganic support.

The two-component product obtained has the drawback of only having a very low concentration of organic material, since the support takes up a considerable amount of space.

This is due to the fact that support products are relatively non-porous and thus adsorb poorly. Thus, nonionic surfactant/sodium carbonate, nonionic surfactant/sodium sulphate or nonionic surfactant/sodium silicate two-component mixtures in powder form contain not more than 30% of their weight of organic material considered.

The use of more porous supports such as precipitation silicas, clays, sodium silicoaluminates, magnesium or calcium silicates, crystalline aluminosilicates or amorphous aluminosilicates such as zeolites makes it possible to obtain mixtures with a higher concentration of organic material, which can contain up to 65% of their weight of organic material.

However, these supports have the drawback of being insoluble in water, which can pose problems in the use envisaged.

Another solution consists in using a crosslinked absorbent organic polymer (absorbent crosslinked polyacrylate, etc.) or a hydrocolloid (starch, guar, etc.); however, this is more expensive and can also have drawbacks as regards denaturing interactions between the support and the organic material.

The Applicant has found a means for preparing stable dispersions of nonionic surfactants, the continuous phase of which consists of a concentrated aqueous solution of alkali metal silicate and the dispersed phase of which consists of droplets or particles of liquid, waxy or pasty nonionic surfactant, these dispersions being converted, by simple drying, into granules by encapsulation of the droplets or particles of nonionic surfactant in a rigid shell of alkali metal silicate.

This solid presentation form has the advantage of leading to a soluble product which is readily available, stable on storage, able to contain high contents of nonionic surfactant and able to provide controlled release of the said surfactant.

The system formed by the nonionic surfactant and the alkali metal silicate, whether it is in the form of granules or an aqueous dispersion, has detergent properties and detergence-adjuvant ("builder") properties which give it the capacity to be used as a constituent of liquid or solid, household or industrial detergent compositions, in particular for washing laundry.

According to the invention, this is a system (S), in the form of granules or an aqueous dispersion, based on at least one liquid, waxy or pasty nonionic surfactant and on an alkali metal silicate, this system being characterized in that it can be obtained by placing in dispersion in a concentrated aqueous solution of an alkali metal silicate as continuous liquid phase, of at least one liquid, pasty or waxy nonionic surfactant (NIA) which is immiscible or poorly miscible with the said concentrated aqueous solution of alkali metal silicate, using at least one nonionic or anionic surfactant (TAS) which is compatible with the said concentrated solution of alkali metal silicate and which is capable of dispersing the liquid, pasty or waxy nonionic surfactant(s) (NIA) in the said concentrated solution of alkali metal silicate, and optionally by drying the dispersion formed, until a rigid shell of alkali metal silicate encapsulating the said droplets or particles of liquid, pasty or waxy nonionic surfactant(s) (NIA).

The expression "liquid, pasty or waxy nonionic surfactant (NIA) which is immiscible or poorly miscible with an aqueous solution of alkali metal silicate" is understood to refer to any nonionic surfactant which, in its natural state, is in liquid, pasty or waxy form under standard temperature and pressure conditions (generally a temperature of about −10 to 45° C. and a pressure of about 0.8 to 1.2 bar) and which is not capable of being dissolved, being hydrated (by salvation of the hydrophilic part) or of being hydrolysed to more than 10% of its weight in the said concentrated silicate solution.

Among the liquid, pasty or waxy nonionic surfactants (NIA), mention may be made in particular of alkoxylated nonionic surfactants.

Mention may be made in particular of those usually used in the field of detergents for washing laundry, such as polyoxyalkylenated (polyethoxyethylenated, polyoxypropylenated, polyoxybutylenated) alkylphenols whose alkyl substituent is $C_6$–$C_{12}$ and containing from 5 to 25 oxyalkylene units; by way of example, mention may be made of Triton X-45, X-114, X-100 or X-102 sold by Rohm & Haas Co. and Igepal NP2 to NP17 from Rhône-Poulenc;

polyoxyalkylenated $C_8$–$C_{22}$ aliphatic alcohols containing from 1 to 25 oxyalkylene (oxyethylene, oxypropylene) units; by way of example, mention may be made of Tergitol 15-S-9 and Tergitol 24-L-6 NMW sold by Union Carbide Corp., Neodol 45-9, Neodol 23-65, Neodol 45-7 and Neodol 45-4 sold by Shell Chemical Co., Kyro EOB sold by The Procter & Gamble Co., Synperonic A3 to A9 from ICI and Rhodasurf IT, DB and B from Rhône-Poulenc;

alkoxylated terpenic hydrocarbons such as ethoxylated and/or propoxylated α- or β-pinenes containing from 1 to 30 oxyethylene and/or oxypropylene units;

products resulting from the condensation of ethylene oxide or of propylene oxide with propylene glycol or ethylene glycol, with a weight-average molecular mass of about 2000 to 10,000, such as the Pluronic products sold by BASF;

products resulting from the condensation of ethylene oxide or of propylene oxide with ethylenediamine, such as the Tetronic products sold by BASF;

$C_8$–$C_1$ ethoxylated and/or propoxylated fatty acids containing from 5 to 25 ethoxylated and/or propoxylated units;

ethoxylated fatty amides containing from 5 to 30 units;

ethoxylated amines containing from 5 to 30 ethoxylated units;

alkoxylated amidoamines containing from 1 to 50, preferably from 1 to 25, most particularly from 2 to 20, oxyalkylene (preferably oxyethylene) units; etc.

Among the concentrated solutions of alkali metal silicate, mention may be made of aqueous solutions of alkali metal silicate with an $SiO_2/M_2O$ molar ratio which can range from 1.5 to 4, preferably from 2 to 3.5, and containing from about 35 to 50% of active material, M representing sodium or potassium; mention may be made most particularly of commercial solutions of sodium silicate with a ratio of about 2 containing from about 45 to 50% of active material, as well as those of sodium silicate with a ratio of about 3 containing from about 35 to 40% of active material.

The small amounts of free water present in these concentrated silicate solutions are not sufficient to dissolve, hydrate (solvate) or hydrolyse the nonionic surfactants (NIA).

The dispersing of the surfactant(s) (NIA) in the said concentrated solution of alkali metal silicate can be carried out using any nonionic or anionic surfactant which is compatible with the concentrated solution of alkali metal silicate, i.e. which can be dissolved or hydrated (solvated) giving an isotropic homogeneous phase with the concentrated solution of alkali metal silicate. This operation can be carried out in particular using at least one nonionic or anionic surfactant (TAS) whose hydrophilic part contains one or more saccharide unit(s).

The said saccharide units generally contain from 5 to 6 carbon atoms. These can be derived from sugars such as fructose, glucose, mannose, galactose, talose, gulose, allose, altose, idose, arabinose, xylose, lyxose and/or ribose.

Among the nonionic or anionic surfactants (TAS) whose hydrophilic part has a saccharide structure containing from 5 to 6 carbon atoms, mention may be made of:

alkylpolyglycosides which can be obtained by condensation (for example by acidic catalysis) of glucose with primary fatty alcohols (U.S. Pat. Nos.3,598,865; 4,565,647; EP-A-132,043; EP-A-132,046, etc.) having a $C_4$–$C_{20}$, preferably $C_8$–$C_{18}$, alkyl group, as well as an average number of glucose units from about 0.5 to 3, preferably from about 1.1 to 1.8, per mole of alkylpolyglycoside (APG); mention may be made in particular of those having a $C_8$–$C_{14}$ alkyl group and on average 1.4 glucose units per mole a $C_{12}$–$C_{14}$ alkyl group and on average 1.4 glucose units per mole a $C_8$–$C_{14}$ alkyl group and on average 1.5 glucose units per mole a $C_8$–$C_{10}$alkyl group and on average 1.6 glucose units per mole sold respectively under the names Glucopon 600 EC®, Glucopon 600 CSUP®, Glucopon 650 EC® and Glucopon 225 CSUP® by Henkel;

galacturonic, glucuronic, D-mannuronic, L-iduronic, guluronic etc. acid derivatives having a hydrocarbon-based chain containing from 6 to 24 carbon atoms, preferably from 8 to 16 carbon atoms, as well as their alkali metal salts (EP-A-532,370);

glucosamides such as lauryl-N-methylglucosamide;

sophorolipids, such as those in acid or lactone form, derived from 17-hydroxyoctadecenic acid.

The respective amounts of nonionic surfactant(s) (NIA), of concentrated solution of alkali metal silicate and of nonionic or anionic surfactant(s) (TAS) used to prepare the system of the invention are such that the content of nonionic surfactant(s) (NIA) represents from about 5 to 60% by weight, preferably from about 5 to 55% by weight, most particularly from about 5 to 45% by weight, of the solids content-of the said dispersion the content of concentrated solution of alkali metal silicate, expressed on a dry basis, represents from about 20 to 70% by weight, preferably from about 30 to 60% by weight, of the solids content of the said dispersion the content of nonionic or anionic surfactant(s) (TAS), expressed on a dry basis, represents from about 5 to 40% by weight, preferably from about 10 to 30% by weight, of the solids content of the said emulsion or dispersion, the solids content of the said dispersion being from about 30 to 90%, preferably from about 40 to 80%, by weight.

The dispersing of the surfactant(s) (NIA) in the said concentrated solution of alkali metal silicate using at least one nonionic or anionic surfactant (TAS) can be carried out according to any method for preparing dispersions which is known to those skilled in the art.

A dispersion can be prepared using high-shear colloidal mills, such as Menton Gaulin®, Microfluidizer® (Microfluidics), etc.

However, it is preferable to prepare a dispersion according to methods using means of moderate stirring.

Thus, a first method which is particularly suitable is direct phase emulsification, which consists in preparing a mixture of concentrated solution of alkali metal silicate and of nonionic or anionic surfactant (TAS) and then in introducing the nonionic surfactant (NIA) therein in liquid form (molten if necessary), with stirring.

Another method is reverse-phase emulsification, which consists in introducing a mixture of concentrated solution of alkali metal silicate and of nonionic or anionic surfactant (TAS), dropwise and with stirring, into the nonionic surfactant (NIA) in liquid form (molten if necessary).

The dispersing by emulsification of the nonionic surfactant (NIA) in the concentrated solution of alkali metal silicate using the nonionic or anionic surfactant (TAS) is carried out at a temperature at which the said nonionic surfactant (NIA) is liquid. The droplets of nonionic surfactant (NIA) obtained during this operation can have diameters of about 0.5 to 10 $\mu$m, preferably from about 0.7 to 5 $\mu$m.

The optional drying of the dispersion in order to obtain granules is carried out under conditions such that the continuous liquid matrix of alkali metal silicate is converted, by elimination of water, into a continuous solid film coating the droplets or the particles of nonionic surfactant (NIA); the amount of water remaining corresponds to a weight ratio—water remaining in the silicate/silicate solids—from about 5/95 to 25/75.

This operation can be carried out by any known means. Preferably, rapid drying of the dispersion is carried out.

Drying by freeze-drying (freezing followed by sublimation) and, most particularly, spray-drying are suitable.

This final mode of drying can be carried out in any known spray-drying apparatus, such as spraying towers which combine spraying of the dispersion through a nozzle or a turbine with a stream of hot air, under conditions such that the temperature of the product during the drying does not exceed 105° C.

The said optional drying operation can also be carried out in the open air in a thin layer in the oven.

The granules thus obtained comprise from about 5 to 60% of their weight, preferably 5 to 55% of their weight, most particularly 5 to 45% of their weight, of nonionic surfactant(s) (NIA)

20 to 70% of their weight, preferably 30 to 60% of their weight, of alkali metal silicate expressed on a dry basis 5 to 40% of their weight, preferably 10 to 30% of their weight, of nonionic or anionic surfactant(s) (TAS), expressed on a dry basis, and water in a water/dry silicate ratio of about 5/95 to 25/75.

According to a specific and improved embodiment of the invention, the said system (S) is in the form of an aqueous dispersion also containing glycerol.

The presence of glycerol makes it possible in particular to improve the stability on storage under warm conditions (40° C.) of the said dispersion system.

The amount of glycerol which can be present is from about 3 to 20% by weight, preferably from about 4 to 20% by weight, most particularly from about 6 to 14% by weight, relative to the total weight of the said dispersion.

The said system (S) in the form of a dispersion can be obtained by carrying out the dispersing according to the methods described above, in particular by direct-phase emulsification or by reverse-phase emulsification, after prior introduction of the glycerol into the concentrated aqueous solution of alkali metal silicate.

The system (S) which forms the subject of the invention, whether in the form of granules or an aqueous dispersion, can be used in household or industrial detergents, as a constituent of a detergent composition, in particular for washing laundry.

The term "constituent" is understood herein to refer both to a simple component for a detergent composition and to the entire detergent composition per se.

The subject of the present invention is thus also the use of the system (S) which forms the subject of the invention as a constituent of a detergent composition, as well as to the detergent compositions comprising or consisting of the said system (S).

When it is present in the form of granules, the said system (S) can be a simple component of a detergent composition in powder form or can constitute by itself a detergent composition in powder form.

When the said system (S) in the form of granules is a simple component of a detergent composition in powder form, it can be added in post-addition to the other components of the said composition, and in an amount corresponding to that desired by the manufacturer. This amount, expressed as nonionic surfactant (NIA), is generally from about 5 to 25 parts by weight per 100 parts of final composition. Among the other components which can be present in the detergent compositions in powder form, mention may be made of inorganic or organic detergent adjuvants ("builders"), in an amount such that the total amount of detergent adjuvant is from about 5 to 50% of the weight of the said composition, these detergent adjuvants being such as polyphosphates (tripolyphosphates, pyrophosphates, orthophosphates, hexametaphosphates) of alkali metals, of ammonium or of alkanolamines tetraborates or borate precursors alkali-metal or alkaline-earth metal carbonates (bicarbonates, sesquicarbonates)

the lamellar silicates described in U.S. Pat. No. 4,664,839, cogranulates of alkali metal silicate hydrates and of alkali metal (sodium or potassium) carbonates rich in silicon atoms, in Q2 or Q3 form, described in EP-A-488,868, for detergent compositions in powder form crystalline or amorphous aluminosilicates of alkali metals (sodium, potassium) or of ammonium, such as zeolites A, P, X, etc.

water-soluble polyphosphonates (ethane 1-hydroxy-1,1-diphosphonates, methylene diphosphonate salts, etc.)

water-soluble salts of carboxylic polymers or copolymers such as water-soluble salts of polycarboxylic acids with a molecular mass of about 2000 to 100,000, obtained by polymerization or copolymerization of ethylenically unsaturated carboxylic acids such as acrylic acid, maleic acid or anhydride, fumaric acid, itaconic acid, mesaconic acid, citraconic acid or methylenemalonic acid, and most particularly polyacrylates with a molecular mass of about 2000 to 10,000 (U.S. Pat. No. 3,308,067), copolymers of acrylic acid and of maleic anhydride with a molecular mass of about 5000 to 75,000 (EP-A-66915)

polycarboxylate ethers (oxydisuccinic acid and its salts, monosuccinic acid tartrate and its salts, disuccinic acid tartrate and its salts)

hydroxypolycarboxylate ethers citric acid and its salts, mellitic acid, succinic acid and their salts polyacetic acid salts (ethylenedianine tetraacetates, nitrilotriacetates, N-(2-hydroxyethyl) nitrilodiacetates)

$C_5$–$C_{20}$-alkyl succinic acids and their salts (2-dodecenyl succinates, lauryl succinates, etc.)

polyacetal carboxylic esters polyaspartic acid, polyglutamic acid and their salts polyimides derived from the polycondensation of aspartic acid and/or glutamic acid polycarboxymethylated derivatives of glutamic acid [such as N,N-bis(carboxymethyl)glutamic acid and its salts, in particular the sodium salts] or of other amino acids aminophosphonates such as nitrilotris(methylene phosphonates)

polyfunctional aromatic compounds such as dihydroxydisulphobenzenes anionic surfactants, in an amount from about 1 to 50%, for instance alkyl ester sulphonates of formula R—CH($SO_3$M)—COOR', where R represents a $C_{8-20}$, preferably $C_{10}$–$C_{16}$, alkyl radical, R represents a $C_1$–$C_6$, preferably $C_1$–$C_3$, alkyl radical and M represents an alkali-metal (sodium, potassium, lithium) cation, an ammonium cation which is substituted or unsubstituted (methyl-, dimethyl-, trimethyl-, tetramethylammonium, dimethylpiperidinium, etc.) or an alkanolamine derivative (monoeth,-nolarninr, diethanolamine, triethanolamine, etc.);

alkyl sulphates of formula ROS$Q_3$M, in which R represents a $C_{10}$–$C_{24}$, preferably $C_{12}$–$C_{20}$ and more particularly $C_{12}$–$C_{18}$, alkyl or hydroxyalkyl radical, M representing a hydrogen atom or a cation of the same definition as above, as well as the ethoxylenated (ED) and/or propoxylenated (PO) derivatives thereof, having on average from 0.5 to 6, preferably from 0.5 to 3, EO and/or PO units;

alkylamide sulphates of formula RCONHR'O$SO_3$M in which R represents a $C_2$–$C_{22}$, preferably $C_6$–$C_{20}$, alkyl radical, R' represents a $C_2$–$C_3$ alkyl radical, M representing a hydrogen atom or a cation of the same definition as above, as well as the ethoxylenated (EO) and/or propoxylenated (PO) derivatives thereof, having on average from 0.5 to 60 EO and/or PO units;

saturated or unsaturated $C_8$–$C_{24}$, preferably $C_{14}$–$C_{20}$, fatty acid salts, $C_9$–$C_{20}$ alkylbenzene sulphonates, primary or secondary $C_8$–$C_{22}$ alkyl sulphonates, alkylglycerol sulphonates, the sulphonated polycarboxylic acids described in GB-A-1,082,179, paraffin sulphonates, N-acyl-N-alkyl taurates, alkyl phosphates, isethionates, alkyl succinamates, alkyl sulphosuccinates, sulphosuccinate monoesters or diesters, N-acylsarcosinates, alkylglycoside sulphates, polyethoxycarboxylates, the cation having the same definition as above.

antisoilinq agents, in amounts of about 0.01–10%, preferably of about 0.1–5% and most particularly of about 0.2–3%, by weight, these agents being such as cellulose derivatives such as cellulose hydroxy ethers, methylcellulose, ethylcellulose, hydroxypropyl methylcellulose, hydroxybutyl methylcellulose, polyvinyl esters grafted onto polyalkylene trunks, such as polyvinyl acetates grafted onto polyoxyethylene trunks (EP-A-219,048)

polyvinyl alcohols polyester copolymers based on ethylene terephthalate and/or propylene terephthalate and polyoxyethylene terephthalate units, in a molar ratio—ethylene terephthalate and/or propylene terephthalate (number of units)/polyoxyethylene terephthalate (number of units)—of about 1/10 to 10/1, preferably from about 1/1 to 9/1, the polyoxyethylene terephthalates having polyoxyethylene units with a molecular weight of about 300 to 5000, preferably of about 600 to 5000 (U.S. Pat. Nos. 3,959,230, 3,893,929, 4,116,896, 4,702,857, 4,770,666);

sulphonated polyester oligomers obtained by sulphonation of an oligomer derived from ethoxylated allyl alcohol, from dimethyl terephthalate and from 1,2-propylenediol, having from 1 to 4 sulphone groups (U.S. Pat. No. 4,968,451);

polyester copolymers based on propylene terephthalate and polyoxyethylene terephthalate units and ending with ethyl units, methyl units (U.S. Pat. No. 4,711,730) or polyester oligomers ending with alkylpolyethoxy groups (U.S. Pat. No. 4,702,857) or sulphopolyethoxy (U.S. Pat. No. 4,721,580) or sulphoaroyl (U.S. Pat. No. 4,877,896) anionic groups sulphonated polyesters with a number-average molecular mass of less than 20,000, obtained from a terephthalic acid diester, from a sulphoisophthalic diester and from a diol (FR-A-2,720,400), polyesterpolyurethanes obtained by reaction of a polyester with a number-average molecular mass of 300–4000, obtained from adipic acid and/or terephthalic acid and/or sulphoisophthalic acid and from a diol, with a prepolymer containing isocyanate end groups, obtained from a polyoxyethylene glycol with a molecular mass of 600–4000 and from a diisocyanate (FR-A-2,334,698)

anti-redeposition agents, in amounts of about 0.01–10% by weight for a detergent composition in powder form, of about 0.01–5% by weight for a liquid detergent composition, these agents being such as ethoxylated monoamines or polyamines, and ethoxylated amine polymers (U.S. Pat. No. 4,597,898, EP-A-11,984)

carboxymethylcellulose sulphonated polyester oligomers obtained by condensation of isophthalic acid, dimethyl sulphosuccinate and diethylene glycol (FR-A-2,236,926)

polyvinylpyrrolidones bleaching agents, in an amount of about 0.1–20%, preferably 1–10%, of the weight of the said detergent composition in powder form, these agents being such as perborates such as sodium perborate monohydrate or tetrahydrate peroxygenated compounds such as sodium carbonate peroxyhydrate, pyrophosphate peroxyhydrate, urea peroxyhydrate, sodium peroxide, sodium persulphate percarboxylic acids and their salts (known as "percarbonates") such as magnesium monoperoxyphthalate hexahydrate, magnesium metachloroperbenzoate, 4-nonylamino-4-oxoperoxybutyric acid, 6-nonylamino-6-oxoperoxycaproic acid, diperoxydodecanedioic acid, peroxysuccinic acid nonylamide, decyldiperoxysuccinic acid preferably combined with a bleaching activator generating, in situ in the washing medium, a peroxycarboxylic acid; among these activators, mention may be made of tetraacetylethylenediamine, tetraacetylmethylenediamine, tetraacetyl glycoluryl, sodium p-acetoxybenzene sulphonate, pentaacetyl glucose, octaacetyl lactose, etc.

fluorescence agents, in an amount of about 0.05–1.2% by weight, these agents being such as derivatives of stilbene, pyrazoline, coumarin, fumaric acid, cinnamic acid, azoles, methinecyanins, thiophenes, etc.

foam suppressants, in amounts which can be up to 5% by weight, these agents being such as $C_{10}$–$C_{24}$ monocarboxylic fatty acids or their alkali-metal, ammonium or alkanolamine salts, fatty acid triglycerides saturated or unsaturated aliphatic, alicyclic, aromatic or heterocyclic hydrocarbons, such as paraffins, waxes, N-alkylaminotriazines monostearyl phosphates, monostearyl alcohol phosphates polyorganosiloxane oils or resins optionally combined with silica particles softeners, in amounts of about 0.5–10% by weight, these agents being such as clays enzymes in an amount which can be up to 5 mg by weight, preferably about 0.05–3 mg, of active enzyme/g of detergent composition, these enzymes being suck as proteases, amylases, lipases, cellulases, peroxidases (U.S. Pat. Nos. 3,553,139, 4 101,457, 4,507,219, 4,261,868)

and other additives such as alcohols (methanol, ethanol, propanol, isopropanol, propanediol, ethylene glycol, glycerol)

buffer agents fragrances pigments.

When the said system (S) in granule form constitutes, by itself, a detergent composition (SD) in powder form, in particular for washing laundry, it is preferable for the amount of alkali metal silicate, expressed on a dry basis, to represent from about 30 to 70%, most particularly from about 40 to 60%, of the weight of the said system expressed on a dry basis, and for that of the nonionic surfactant (NIA) to represent from about 10 to 35%, most particularly from about 15 to 30%, of the weight of the said system expressed on a dry basis.

When it is in the form of an aqueous dispersion, it is preferable for the said system (S) to constitute the liquid detergent composition itself. In this case, it can be presented in its natural state (i.e. composed of its three basic constituents—alkali metal silicate, nonionic surfactant (NIA) and nonionic or anionic surfactant (TAS)—water and optionally glycerol) or it can be added to other detergent components introduced during its preparation.

In order to make up a liquid detergent composition (SD) in its natural state, in particular for washing laundry, the said system (S) in the form of an aqueous dispersion contains an amount of alkali metal silicate, expressed on a dry basis, of about 30 to 70%, preferably from about 40 to 60%, of the weight of the said system expressed on a dry basis, and an amount of nonionic surfactant (NIA) of about 5 to 35%, preferably from about 5 to 30%, of the weight of the said system, expressed on a dry basis.

The said system (S) in the form of an aqueous dispersion, to which at least one detergent component is added during its preparation, can constitute a liquid detergent composition, in particular for-washing laundry.

The nature and amount of the components and also the amount of any water introduced via these components are chosen so as not to destructure the liquid dispersion. It is preferable for the total amount of these components not to exceed 10% of the weight of the final detergent composition.

The mode of introduction of the said additive(s) into the said system (S) in the form of a dispersion depends on the behaviour of the said additive(s) towards the concentrated silicate solution and the nonionic surfactant (NIA).

Among the additives, mention may be made in particular of:

1) detergent additives which are soluble or dispersible but not hydrolysable in the concentrated solution of alkali metal silicate, such as water-soluble salts of carboxylic polymers or copolymers, such as water-soluble salts of polycarboxylic acids with a molecular mass of about 2000 to 100,000, obtained by polymerization or copolymerization of ethylenically unsaturated carboxylic acids such as acrylic acid, maleic acid or anhydride, fumaric acid, itaconic acid, mesaconic acid, citraconic acid, methylenemalonic acid, and most particularly polyacrylates with a molecular mass of about 2000 to 10,000 (U.S. Pat. No. 3,308,067), copolymers of acrylic acid and of maleic anhydride with a molecular mass of about 5000 to 75,000 (EP-A-66,915); they can be used in an amount (expressed on a dry basis) of about 0.5 to 6% of the weight of detergent composition, expressed on a dry basis.
   - polypeptides such as polyaspartic acid, polyglutamic acid and their salts, in an amount (expressed on a dry basis) of about 0.5 to 6% of the weight of detergent composition, expressed on a dry basis.
   - water-soluble polyphosphonates (ethane 1-hydroxy-1, 1-diphosphonates, methylene diphosphonate salts, etc.), in an amount (expressed on a dry basis) of about 0.5 to 6% of the weight of detergent composition, expressed on a dry basis
   - salts of polyacetic acids (ethylenediaminetetraacetates, nitrilotriacetates, N-(2-hydroxyethyl)-nitrilodiacetates), in an amount (expressed on a dry basis) of about 0.5 to 6% of the weight of the detergent composition expressed on a dry basis
   - polycarboxymethyl derivatives of glutamic acid [such as N, N-bis(carboxymethyl)glutamic acid and its salts, in particular the sodium salt] or other amino acids, in an amount (expressed on a dry basis) of about 0.5 to 6% of the weight of detergent composition expressed on a dry basis
   - alkali metal carbonates (bicarbonates, sesquicarbonates) , in an amount (expressed on a dry basis) of about 1 to 10% of the weight of detergent composition expressed on a dry basis
   - optical brighteners such as stilbene, pyrazoline, coumarin, fumaric acid, cinnamic acid, azole, methinecyanine and thiophene derivatives, in an amount, expressed on a dry basis, of about 0.1 to 0.5% of the weight of detergent composition expressed on a dry basis.

Additives of this type can be introduced into the said system (S) by premixing the additive(s) with the solution of alkali metal silicate, the nonionic surfactant (NIA) then being dispersed in the said mixture using the surfactant (TAS).

2) detergent additives that are soluble or dispersible in the nonionic surfactant (NIA), such as, in particular, enzymes such as proteases, amylases, lipases, cellulases and peroxidases (U.S. Pat. Nos. 3,553,139, 4,101, 457, 4,507,219, 4,261,868), in an amount, expressed on a dry basis, of about 0.1 to 0.5% of the weight of detergent composition expressed on a dry basis.

This type of additive can be introduced into the said system by dispersion or solubilization in the liquid nonionic surfactant (NIA), before dispersing the said nonionic surfactant (NIA) in the silicate solution.

3) detergent additives that are insoluble in the silicate solution and in the liquid nonionic surfactant (NIA), such as, in particular, foam suppressants such as
   - saturated or unsaturated, aliphatic, alicyclic, aromatic or heterocyclic hydrocarbons, such as paraffins and waxes
   - monostearyl phosphates, monostearyl alkyl phosphates
   - polyorganosiloxane oils or resins optionally combined with silica particles in an amount, expressed on a dry basis, of about 0.1 to 0.5% of the weight of detergent composition expressed on a dry basis.

This type of additive can be introduced into the system (S) by dispersing in the silicate solution via the surfactant (TAS), followed by addition of the nonionic surfactant (NIA). The system formed here is a co-dispersion.

The detergent composition formed by the said system (S) in the form of an aqueous dispersion, either in its natural state or to which at least one detergent compound is added during its preparation, can be used both for the main wash of the laundry and for removing stains prior to washing.

The expression "prewash stain remover" ("prespotter") is understood to refer to a product which, when applied before washing, without prediluting it, to the soiled area of the laundry, allows better removal of the soiling during the main wash.

The examples below are given without any limitation being implied.

EXAMPLE 1

An aqueous emulsion is prepared containing

- 40 parts by weight of Synperonic A7, linear $C_{12}$–$C_{14}$ alcohol ethoxylated with 7 mol of ethylene oxide
- 40 parts by weight (expressed on a dry basis) of sodium silicate solution with an $SiO_2/Na_2O$ ratio of 2, containing 45% solids
- 20 parts by weight (expressed on a dry basis) of Glucopon 600 CSP (alkylpolyglucoside solution containing 50% solids) by:
  - introducing the Glucopon 600 CSP into the aqueous sodium silicate solution in a 2-litre reactor fitted with a frame-paddle stirrer,
  - heating to 60° C. for 10 minutes with stirring at a speed of 200 revolutions/min
  - dropwise addition of the Synperonic A7 with stirring at 1000 revolutions/min, leaving the mixture obtained to stand for about 48 hours passing the said mixture into a microfluidizer at 500 bar, and leaving to stand for about 24 hours.

The emulsion obtained is stable; it has a homogeneous drop diameter of less than one micrometre and a viscosity lower than that of the starting silicate solution. The emulsion is dried as a thin layer of 1 cm on a glass slide in the oven at 60° C., for 24 hours.

The product obtained contains 4% by weight of water; it can be ground and flows freely, although it contains more than 50% of nonionic surfactant.

Example 2

The following liquid detergent formulation

| components of the formulation | parts by weight |
|---|---|
| sodium silicate solution with an $SiO_2/Na_2O$ ratio of 2, containing 45% solids | 79.3 |
| Tinopal SOP + Tinopal DMSX (optical brighteners) | 0.2 |
| Glucopon 600 CSP, containing 50% solids | 10 |
| Synperonic A7 | 10 |
| Savinase 32 KNUP (protease from Novo) | 0.3 |
| Rhodorsil 20476 anti-foaming agent | 0.2 |

(i.e. 15 parts by weight, expressed on a dry basis, of surfactants per 100 parts by weight of detergent formulation) is prepared by:

successive introduction into a 2-litre reactor maintained at 40° C. with continuous stirring at 200 revolutions/minute using a frame-paddle mixer of the silicate solution of the optical brighteners and stirring for 5 minutes addition of glucopon 600 CSP addition of a premix, prepared at 30° C., of Synperonic A7 and of enzyme followed by introduction of the anti-foaming agent.

The mixture is homogenized at 1000 revolutions/minute while avoiding the introduction of air.

The detergent and anti-redeposition power of the above detergent formulation is tested as follows.

Principle

The test simulates a simplified machine wash, using a tergotometer. It consists in washing, at 40° C. in water with a hardness of 30° TH, test pieces of fabrics, soiled in a standard and uniform manner, with the test formulation. The wash lasts thirty minutes and the detergency is evaluated by measuring the whiteness of the pieces of fabric, before and after washing, using a calorimeter. In addition, unsoiled white control fabrics are incorporated, which allow the redeposition of the soiling to be evaluated by measuring the reflectances before and after washing.

Apparatus and Materials

Materials

Tergotometer: "US Testing Co. Inc." Hoboken N. J., Model 7243.

Rolling machine for ironing the samples of fabric after washing.

"Dr. Lange LUCI 100" colour measurement machine.

Fabrics

The standard fabrics are manufactured by the CFT (Center for Test materials) or by the company "Test Fabric". They have the following characteristics:

| Standard soiled fabrics | (soiling) | Number of pieces per test |
|---|---|---|
| Soiled cotton CS-2 CFT | (cocoa) | 2 |
| Soiled cotton CS-1 CFT | (blood) | 2 |
| Soiled cotton K 10D CFT | (sebuin) | 2 |
| Soiled polyester K 30D CFT | (sebum) | 2 |
| Soiled cotton AS-2 CFT | (mineral oil and sweat) | 2 |
| Polyester cotton EMPA 1D4 CFT | (mineral oil and ink) | 2 |
| Polyester test fabric | (sweat) | 2 |
| Standard white fabrics | | |
| Unsoiled white cotton CN1, from the CFT | | 5 |
| Unsoiled white polyester cotton PCN 1, from the CST | | 5 |

i.e., for each test, a total of 24 pieces of fabric.

Procedure

Detergency Test

The tergotometer is a machine consisting of 4 stainless steel 2-litre pots onto which are fitted stirrers set at 50 cycles per minute (100 to-and-fro motions). The pots are placed in a tank of water adjusted to 40° C.

1 litre of water containing 8.2 g of test formulation is placed in each pot.

When the water is at the right temperature, the pots are placed in the thermostatically-controlled bath while simultaneously starting the stirring and a chronometer.

At the end of the wash (30 minutes) the baths are recovered (250 cc) in order to check the pH. The fabrics are rinsed three times with mains water, then wrung out by hand and individually dried flat between two sheets of absorbent white paper.

The fabrics are again placed between two sheets of clean absorbent paper and ironed in the rolling machine at a temperature of about 110° C.

Colour Measurement

Colour measurements are carried out using the "LUCI 100" calorimeter before and after washing, according to the "L", "a", "b" system (scale from black to white, from green to red and from blue to yellow) for measuring the detergent power of the test surfactants (increase in the whiteness of the soiled pieces of fabric).

Calculating the Detergency

The value "DE" (detergency) is calculated for each type of fabric by determining the geometrical sum of the colour differences DL, Da and Db before and after washing on the soiled fabrics:

ie.

detergency $DE=(DL^2+Da^2+Db^2)^{1/2}$

Anti-redeposition Power

The anti-redeposition power of the test products is demonstrated using unsoiled standard white cotton fabrics CN1 and polyester/cotton fabrics PCN1, whose colour before and after washing is measured. The redeposition is the difference in reflectance between the initial white fabric and the white fabric which has undergone washing in the presence of soiled fabrics.

The encrustation inhibiting effect is measured after 6 washes at 60° C. in 40° TH hard water, in the absence of soiled fabrics for the following unsoiled test pieces:

cotton CN1

Terry cotton 12A

The inorganic encrustation is calculated from the ash content (as a % relative to the total weight of the cotton) of the washed and dried fabrics incinerated at 950° C. for 3 hours.

The results obtained are featured in Table 1 and are compared with those obtained with the same amount (8.2 g/l) of a commercial compact washing liquid containing 50% of its weight of surfactants.

It is observed that the detergent power of the formulation of the invention is markedly higher than that of the commercial washing product, although the surfactant content of the formulation of the invention (15%) is markedly lower than that (50%) of the commercial washing product.

Example 3

Aqueous emulsions are prepared containing

- 12 parts by weight of Synperonic A7, linear $C_{12}$–$C_{14}$ alcohol ethoxylated with 7 mol of ethylene oxide
- 6 parts by weigt (expressed on a dry basis) of Glucopon 600 CSP (solution of alkylpolyglucoside containing 50% solids)
- a sodium silicate solution with an $SiO_2/Na_2O$ ratio of 2, containing 45% solids, in the amounts given in Table 2
- glycerol in the amounts given in Table 2 by:
  - introducing the Glucopon 600 CSP into a premix of the glycerol and the aqueous sodium silicate solution in a 2-litre reactor fitted with a frame-paddle stirrer,
  - heating to 60° C. for 10 minutes with stirring at a speed of 200 revolutions/min
  - adding the Synperonic A7 dropwise, with stirring at 1000 revolutions/min
  - leaving the mixture obtained to stand for about 48 hours
  - passing the said mixture into a microfluidizer at 500 bar, and
  - leaving to stand for about 24 hours.

The stability of the emulsions is observed after 1 day, 3 days, 5 days and 20 days of storage in stoppered flasks, in an oven at 40° C.

The results are featured in Table 2.

It is observed that:

- the emulsion containing no glycerol (3a) or 1% (3b) of glycerol shows 60% dephasing after 5 days
- the emulsions containing 4% (3c) or 19% (3d) by weight of glycerol still show no dephasing after 20 days.

Example 4

The following liquid detergent formulation

| components of the formulation | parts by weight |
|---|---|
| sodium silicate solution with an $SiO_2/Na_2O$ ratio of 2, containing 45% solids | 75.5 |
| glycerol | 4 |
| Glucopon 600 cSP, containing 50% solids | 10 |
| Synperonic A7 | 10 |
| Savinase 32 KNUP (protease from Novo) | 0.3 |
| Rhodorsil 2047G anti-foaming agent | 0.2 |

(i.e. 15 parts by weight, expressed on a dry basis, of surfactants per 100 parts by weight of detergent formulation) is prepared by:

- introducing the silicate solution containing the glycerol into a 2-litre reactor maintained at 40° C., with continuous stirring at 200 revolutions/minute using a frame-paddle stirrer
- adding the Glucopon 600 CSP
- adding a premix, prepared at 30° C., of Synperonic A7 and of enzyme
- then introducing the anti-foaming agent.

The mixture is homogenized at 1000 revolutions/minute while avoiding the introduction of air.

The detergent power according to the test described in Example 2 is given in Table 1.

It is observed that the presence of glycerol also makes it possible to improve the washing performance.

Examples 5a and 5b

Two detergent compositions in powder form are prepared, one consisting, to 100%, of granules prepared in Example 1, the other consisting, to 80%, of the said granules and, to 20%, of other additives mentioned in Table 3.

The detergent and anti-encrusting power of these two compositions is compared with that of a commercial washing powder, containing more than 35 constituents, including a complex detergency adjuvant ("builder") system based on zeolite, sodium carbonate and polymers, a surfactant system (18%) composed of 4 different products, an enzymatic system and an activated bleaching system.

The detergent power is measured in a Tergotometer according to the method described in Example 2, making the following changes thereto:

- washing time: 20 minutes (instead of 30 minutes)
- 5 g/l of test composition (instead of 8.2 g/l) on the following types of soiling

| Standard soiled fabrics | (soiling) | No. of pieces per test |
|---|---|---|
| Cotton BC-3 CFT | (tea) | 2 |
| Soiled cotton CS-3 CFT | (wine) | 2 |
| Cotton EMPA SUNAK | (oxidizable soiling) | 2 |
| Polyester test fabric | (sweat) | 2 |
| Soiled cotton K 10D CFT | (sebum) | 2 |
| Soiled cotton/polyester K 20D CFT | (sebum) | 2 |
| Soiled polyester K 30D CFT | (sebum) | 2 |

-continued

| Standard soiled fabrics | (soiling) | No. of pieces per test |
|---|---|---|
| Soiled cotton AS-2 CFT | (mineral oil and sweat) | 2 |
| Soiled cotton CS-2 CFT | (cocoa) | 2 |
| Soiled cotton CS-1 CFT | (blood) | 2 |

The encrustation-inhibiting effect is measured as in Example 2.

The results obtained are featured in Table 3.

Example 6

Prewash Stain Remover ("prespotter")

An aqueous emulsion is prepared as in Example 3, containing

| components of the emulsion | parts by weight |
|---|---|
| sodium silicate solution with an $SiO_2/Na_2O$ ratio of 2, containing 45% solids | 80 |
| glycerol | 4 |
| Glucopon 600 CSP, containing 50% solids | 8 |
| Synperonic A7 | 8 |

The stain removing power of this emulsion (prewash stain remover) is tested as follows:

Principle

The test agent is deposited in concentrated form onto the soiled fabric and spread out locally using a spatula.

A contact time of 5 minutes between the textile and the product is observed, before proceeding to the actual wash using a washing product in an AEG brand domestic washing machine, on a 40° C. cycle.

Details

Standard 10×10 cm soiling test samples prepared by specialist laboratories are used, namely

| Standard soiled fabrics | (soiling) |
|---|---|
| Soiled cotton K 10D CFT | (sebum) |
| Soiled cotton/polyester K 20D CFT | (sebum) |
| Soiled polyester K 30D CFT | (sebum) |
| Soiled cotton AS-2 CFT | (mineral oil and sweat) |
| Polyester/cotton EMPA 104 from St. Gall | (sweat) |

These 5 test samples are sewn flat onto a 60×40 cm cotton towel. 15 g of agent to be evaluated are placed on the soiled test samples and spread out in a circle approximately 3 cm in diameter.

After a contact time of 5 minutes, the test samples (on their towel support) are introduced into an AEG domestic washing machine, accompanied by a 3 kg load of laundry consisting of clean Terry towels.

A wash cycle at 40° C. was then carried out, with 100 g of standard ARIEL-brand commercial washing product.

After washing, the test samples are inspected visually in order to evaluate the additional detergent effect due to the local presence of stain remover.

Lighter zones, located at the place where the stain remover was deposited, allow this effect to be observed visually.

(It would also have been possible to carry out laboratory trichromatic measurements in order to quantify the additional detergent effect).

The aqueous emulsion tested as prewash stain remover is compared with a surfactant-rich commercial product of the following composition:

| | |
|---|---|
| anionic surfactant | 15% |
| nonionic surfactant | 5% |
| pearlescent base | 1% |
| water | 19% |

The performance levels of the test emulsion are visually superior to those of the commercial product, in particular on sebum-based soiling, although the test emulsion has a lower concentration of surfactants.

TABLE 1

| | Liquid formulation | | |
|---|---|---|---|
| | commercial | of Example 2 | of Example 4 |
| Detergency | | | |
| CS2 | 19.45 | 14.98 | 16.11 |
| CS1 | 31.82 | 39.28 | 39.16 |
| K10D | 14.96 | 13.6 | 12.82 |
| AS2 | 17.37 | 17.98 | 23.17 |
| EMPA104 | 12.02 | 17.74 | 22.80 |
| TF polyester (sweat) | 26.41 | 20.95 | 21.60 |
| K30D | 11.22 | 16.8 | 17.60 |
| cumulative detergency | 133.3 | 141.3 | 153.3 |
| Anti-redeposition | | | |
| CN1 | −1.74 | −2.3 | |
| PCN1 | −1.14 | −2.1 | |
| Encrustation | | | |
| CN1 | 0.16 | 0.42 | |
| 12A | 0.88 | 0.63 | |

TABLE 2

| | Example | | | |
|---|---|---|---|---|
| Emulsion | 3a | 3b | 3c | 3d |
| Synperonic A7 | 12 | 12 | 12 | 12 |
| Glucopon 600 CSP (50% solids) | 12 | 12 | 12 | 12 |
| Glycerol | 0 | 1 | 4 | 19 |
| Sodium silicate solution (45% solids) | 76 | 75 | 72 | 56 |
| % dephasing after | | | | |
| 1 day | 30 | 25 | 0 | 0 |
| 3 days | 50 | 40 | 0 | 0 |
| 5 days | 60 | 60 | 0 | 0 |
| 20 days | 65 | 65 | 0 | 0 |

TABLE 3

| Solid detergent composition | Examples 5a | 5b | Comparative |
|---|---|---|---|
| Components | | | |
| granules of Example 1 | 100 | 80 | |
| bleaching system | | | |
| perborate monohydrate | | 15 | |
| TAED | | 4 | |
| enzymatic system | | | |
| protease (savinase) | | 0.5 | |
| amylase (termamyl) | | 0.5 | |
| Commercial composition | | | 100 |
| Detergency | | | |
| BC3 | 5.2 | 8.3 | 6.3 |
| CS3 | 11.6 | 15.6 | 14.5 |
| SUNAK | 12.5 | 18.6 | 18.0 |
| TF | 29.3 | 25.6 | 18.5 |
| K10D | 13.2 | 12.9 | 13.6 |
| K20D | 18.8 | 17.8 | 14.5 |
| K30D | 19.6 | 16.1 | 16.0 |
| AS2 | 24.9 | 22.2 | 26.8 |
| CS2 | 10.9 | 15.8 | 24.9 |
| CS1 | 17 | 21.8 | 20.6 |
| cumulative detergency | 163 | 174.7 | 173.7 |
| Encrustation | | | |
| CN1 | 0.23 | 0.17 | 0.35 |
| 12A | 0.83 | 0.56 | 0.81 |

What is claimed is:

1. A method of forming granules comprising a rigid shell of alkali metal silicate encapsulating droplets or particles of a liquid, waxy or pasty nonionic surfactant, said method comprising:

creating a dispersion comprising a concentrated aqueous solution of an alkali metal silicate forming a continuous liquid phase, the at least one liquid, waxy, or pasty nonionic surfactant which lacks miscibility with the solution of alkali metal silicate, and at least one nonionic or anionic surfactant compatible with the alkali metal solution and which disperses the liquid, waxy, or pasty nonionic surfactant within the alkali metal silicate solution; and drying the dispersion;

thereby forming the rigid shell of alkali metal silicate encapsulating the droplet or particle of liquid, waxy, or pasty nonionic surfactant.

2. The method of claim 1, wherein said granules contain about 5 to 25 % by weight of water.

3. The method of claim 1, wherein the nonionic surfactant is:

a polyoxyalkylenated alkylphenol containing a $C_6$–$C_{12}$ alkyl substituent and from 5 to 25 oxyalkylene units;

a polyoxyalkylenated $C_8$–$C_{22}$ aliphatic alcohol containing from 1 to 25 oxyalkylene units;

α- or β-pinenes containing from 1 to 30 oxyethylene units, oxypropylene units or combination thereof;

a condensation product of ethylene oxide or of propylene oxide with propylene glycol or ethylene glycol having a weight-average molecular weight of about 2000 to 10,000;

$C_8$–$C_{18}$ ethoxylated propoxylated fatty acid containing from 5 to 25 ethoxylated units, propoxylated units or combination thereof;

an ethoxylated fatty amide containing from 5 to 30 ethoxylated units;

an ethoxylated amine containing from 5 to 30 ethoxylated units; or an alkoxylated amidoamines containing from 1 to 50 oxyalkylene units.

4. The method of claim 1, wherein said aqueous solution of alkali metal silicate has an $SiO_2/M_2O$ molar ratio ranging from 1.5 to 4 and contains from about 35 to 50% by weight of an active material, wherein M is sodium or potassium.

5. The method of claim 1, wherein said method further comprises adding at least one detergent additive, wherein said detergent additive, expressed on a dry basis, does not exceed 10% by weight of said granules and is:

soluble or dispersible but not hydrolyzable in the concentrated solution of alkali metal silicate;

soluble or dispersible in the nonionic surfactant; or insoluble in the silicate solution and in the liquid nonionic surfactant.

6. The method of claim 1, wherein said dispersion having a solids content of 40 to 80% by weight, said granules comprise:

5 to 60% by weight of said at least one nonionic surfactant;

20 to 70% by weight of concentrated solution of alkali metal silicate; and 5 to 40% by weight of said at least one nonionic or anionic surfactant, expressed on a dry basis.

7. The method of claim 1, wherein the nonionic or anionic surfactant has a hydrophilic part containing one or more $C_5$–$C_6$ saccharide unit(s).

8. The method of claim, 7, wherein the nonionic or anionic surfactant is:

an alkylpolyglycoside;

a galacturonic, glucuronic, D-mannuronic, L-iduronic or guluronic acid derivative or metal salt thereof, said derivative or metal salt having a hydrocarbon-based chain containing from 6 to 24 carbon atoms;

a glucosamide; or a sophorolipid.

9. The method of claim 8 wherein said method further comprises adding a glycerol.

10. The method of claim 9 wherein the amount of glycerol represents from about 3 to 20% of the total weight of said dispersion.

11. The method of claim 8, wherein the solids content comprises 5 to 35% by weight of said nonionic surfactant and 30 to 70% by weight of said concentrated solution of alkali metal silicate, expressed on a dry basis.

12. The method of claim 11, wherein the solids content comprises 10 to 35% by weight of said nonionic surfactant and 30 to 70% by weight of said alkali metal silicate, expressed on a dry basis.

13. The method of claim 1, wherein said liquid, waxy, or pasty nonionic surfactant is not capable of being dissolved, hydrated, or hydrolyzed by more than 10% of its weight in said alkali metal silicate solution.

14. The method of claim 1, wherein said nonionic or anionic surfactant is hydrated or dissolved within the alkali metal silicate solution rendering an isotropic homogenous phase therewith.

15. The method of claim 1, wherein the solids content of said dispersion is 30 to 90%, by weight.

16. The method of claim 1, wherein said granules comprise a water/dry silicate ratio of about 5/95.

17. The method of claim 1, wherein said ratio is about 25/75.

18. The method of claim 1, wherein said shell comprises a continuous solid film coating the droplets or particles of nonionic surfactant.

* * * * *